US005389478A

United States Patent [19]

Yoshida et al.

[11] Patent Number: 5,389,478

[45] Date of Patent: Feb. 14, 1995

[54] ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

[75] Inventors: Akira Yoshida, Sagamihara; Koji Goto; Fumio Sumino, both of Yokohama, all of Japan

[73] Assignee: Canon Kabushiki Kaisha, Tokyo, Japan

[21] Appl. No.: 108,168

[22] Filed: Aug. 18, 1993

Related U.S. Application Data

[63] Continuation of Ser. No. 872,143, Apr. 22, 1992, abandoned.

[30] Foreign Application Priority Data

Apr. 24, 1991 [JP] Japan ..... 3-94379

[51] Int. Cl.[6] ..... G03G 5/06

[52] U.S. Cl. ..... 430/59; 430/73; 358/296

[58] Field of Search ..... 430/73, 76, 77, 78, 430/83, 58, 59; 358/296

[56] References Cited

U.S. PATENT DOCUMENTS

| | | | |
|---|---|---|---|
| 4,055,421 | 10/1977 | Ohta | 430/81 |
| 4,680,244 | 7/1987 | Lehmann et al. | 430/69 |
| 4,760,006 | 7/1988 | Pawlowski | 430/78 |
| 4,877,701 | 10/1989 | Hiro et al. | 430/59 |

FOREIGN PATENT DOCUMENTS

| | | | |
|---|---|---|---|
| 0149802 | 7/1985 | European Pat. Off. . | |
| 0166230 | 1/1986 | European Pat. Off. . | |
| 0384354 | 8/1990 | European Pat. Off. . | |
| 2602064 | 7/1987 | France . | |
| 63-159856 | 7/1988 | Japan | G03G 5/05 |

OTHER PUBLICATIONS

Patent Abstracts of Japan, vol. 12, No. 427 (P-7840 [3274], Nov. 11, 1988.

*Primary Examiner*—John Goodrow

*Attorney, Agent, or Firm*—Fitzpatrick, Cella, Harper & Scinto

[57] ABSTRACT

An electrophotographic photosensitive member has an electroconductive support, and a photosensitive layer formed thereon. The photosensitive layer contains a compound represented by the formula (1).

22 Claims, 1 Drawing Sheet

ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

This application is a continuation of application Ser. No. 07/872,143, filed Apr. 22, 1992, now abandoned.

BACKGROUND OF THE INVENTION

1. Field of the Invention

The present invention relates to an electrophotographic photosensitive member, particularly to an electrophotographic photosensitive member having a photosensitive layer which does not cause image deterioration on repeated image formation and exhibits excellent durability.

The present invention relates also to an electrophotographic apparatus, a device unit, and a facsimile machine employing the above electrophotographic photosensitive member.

2. Related Background Art

Many kinds of electrophotographic photosensitive members employing an organic compound as the photoconducting substance have been developed and practically used so far.

Such electrophotographic photosensitive members employing an organic photoconductive substance are expected to be further improved in electrophotographic properties such as sensitivity and photoresponsiveness because of the flexibility in material design thereof, and are advantageous in ease of film formation, high productivity, and relatively low cost.

However, such types of photosensitive members generally have serious disadvantages of low durability. The durability includes electrophotographic durability such as of sensitivity, residual potential, chargeability, blurring of images, etc. and mechanical durability such as resistance to abrasion and scratching of the surface of the photosensitive member by rubbing. It is already known that the lowering of the durability of the electrophotographic properties results mainly from the deterioration of the organic photoconductive substance in the photosensitive layer caused by ozone, NOx, or the like generated by a corona charger.

The deterioration of the organic photoconductive substance leads to crushed images and undecipherable images, namely blurring of images. The deterioration was found to be more remarkable with organic photoconductive substances having a lower oxidation potential since the deterioration results from a kind of oxidation.

From the viewpoint of the electrophotographic properties, polishing of the surface of the photosensitive member to constantly provide a fresh surface is effective for obtaining high-quality images. On the other hand, from the viewpoint of the mechanical durability, less abrasion is desired and therefore a slipping agent is dispersed on the surface of the photosensitive member, which retards the rapid removal of the deteriorated charge-transporting substance and tends to cause blurring of images.

To solve such problems, for example, Japanese Patent Application Laid-Open No. Sho-63-30850 discloses use of a compound having an oxidation potential of not less than 0.6 V as the charge-transporting substance contained in the surface layer of the photosensitive member.

Recently, as the result of prolongation of the life of the photosensitive member, the problem has surfaced that, when the photosensitive member is left standing in a copying machine for a long time after continuous use, the chargeability of a photosensitive member becomes apparently lowered at the portion of the photosensitive member kept in proximity to the corona-discharging charger. This cause a so-called dormant memory phenomenon, giving blank areas in stripes (white bands in positive development, and black bands in reversal development) in the image.

This dormant memory phenomenon is especially remarkable when the employed charge-transporting substance has an oxidation potential of 0.6 V or higher. The occurrence of the aforementioned blurring of images is caused by ozone or NOx generated by corona discharge. In the case where the employed charge-transporting substance has an oxidation potential of less than 0.6 V, the charge-transporting substance itself is oxidized by the ozone or NOx at the surface of the photosensitive member which causes lower resistance, and is liable to cause blurring of images. On the other hand, in the case where the employed charge-transporting substance has an oxidation potential of not less than 0.6 V, the charge-transporting substance is relatively resistant to oxidation, and therefore the ozone or NOx is considered to penetrate deeply into the photosensitive layer to oxidize the charge-generating substance and lower the resistance thereof, whereby hole injection from the support is promoted, resulting in lower apparent potential and causing a dormant memory phenomenon. Although this reduction in the apparent potential is considered to occur during the use of the photosensitive member, the reduction occurs uniformly throughout the surface of the photosensitive member, so that the blanking of images caused by local potential drop is not observed. When the photosensitive member is left standing after continuous operation, local potential drop occurs in the vicinity of the charger where the concentrations of ozone and NOx are extremely high, resulting in blanking of images to a remarkable extent.

SUMMARY OF THE INVENTION

An object of the present invention is to provide an electrophotographic photosensitive member which is capable of giving images of high quality without blurring nor blanking of images.

Another object of the present invention is to provide an electrophotographic photosensitive member which is capable of giving stably high-quality images without accumulation of the residual potential even after repeated use.

A further object of the present invention is to provide an electrophotographic apparatus, a device unit, and a facsimile machine employing the photosensitive member.

The present invention provides an electrophotographic photosensitive member comprising an electroconductive support and a photosensitive layer formed thereon, the photosensitive layer containing a compound represented by the formula (1) below:

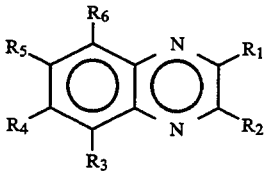

(1)

wherein $R_1$, $R_2$, $R_3$, $R_4$, $R_5$, and $R_6$ are respectively a hydrogen atom, a hydroxy group, a carboxyl group, a substituted or unsubstituted alkyl group, a substituted or unsubstituted alkenyl group, a substituted or unsubstituted alkoxy group, a substituted or unsubstituted aryl group, or substituted or unsubstituted heterocyclic group; the groups of $R_1$ to $R_6$ may be the same or different; and $R_1$ and $R_2$, $R_3$ and $R_4$, $R_4$ and $R_5$, and $R_5$ and $R_6$ may link together to form a ring.

The present invention further provides an electrophotographic apparatus, a device unit, and a facsimile machine employing the photosensitive member defined above.

DESCRIPTION OF THE PREFERRED EMBODIMENT

Figure 1:
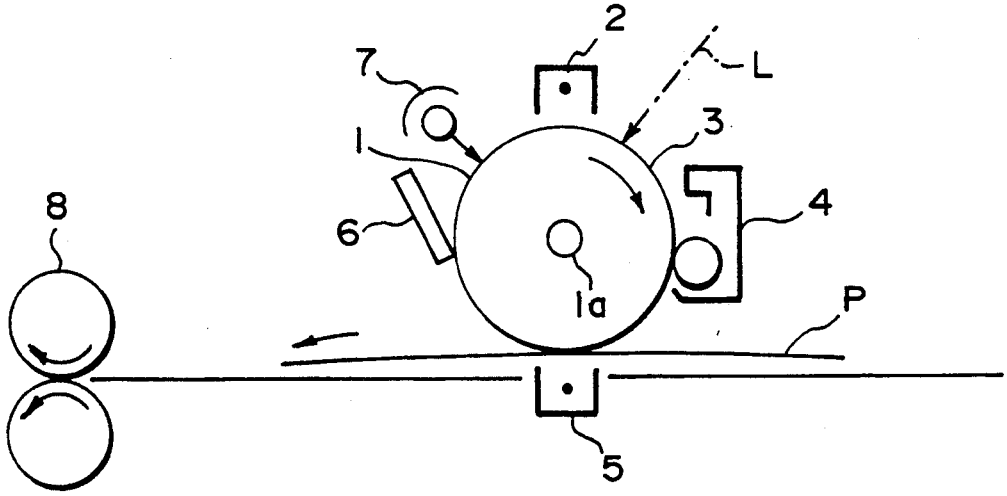
FIG. 1 illustrates roughly the constitution of an electrophotographic apparatus employing the photosensitive member of the present invention.

The electrophotographic photosensitive member of the present invention comprises a photosensitive layer containing the compound represented by the formula (1) below

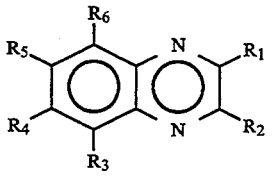

(1)

wherein $R_1$, $R_2$, $R_3$, $R_4$, $R_5$, and $R_6$ are respectively a hydrogen atom, a hydroxy group, a carboxyl group, a substituted or unsubstituted alkyl group, a substituted or unsubstituted alkenyl group, a substituted or unsubstituted alkoxy group, a substituted or unsubstituted aryl group, or substituted or unsubstituted heterocyclic group; the groups of $R_1$ to $R_6$ may be the same or different; and $R_1$ and $R_2$, $R_3$ and $R_4$, $R_4$ and $R_5$, and $R_5$ and $R_6$ may link together to form a ring.

In the formula (1), the alkyl group includes methyl, ethyl, propyl, etc.; the alkenyl group includes vinyl, propenyl, allyl, etc.; the alkoxy group includes methoxy, ethoxy, propoxy, etc.; the aryl group includes phenyl, naphthyl, etc.; and the heterocyclic group includes pyridyl, pyrimidyl, thiazolyl, etc.

The substituent which may substitute the above groups includes halogen atoms; the alkyl groups, the alkenyl groups, the alkoxyl groups, the aryl groups and the heterocyclic groups mentioned above.

The compound of the formula (1) is exemplified below specifically without limiting the invention.

Exemplified Compound No.

1.
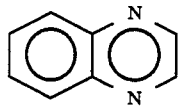

2.
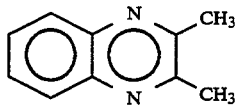

3.
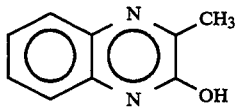

4.
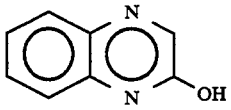

5.
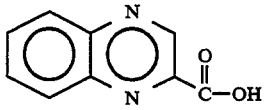

6.
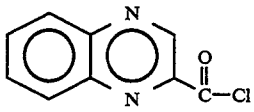

7.
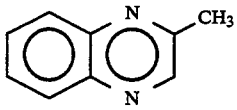

8.
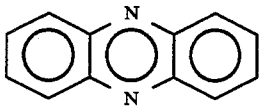

9.
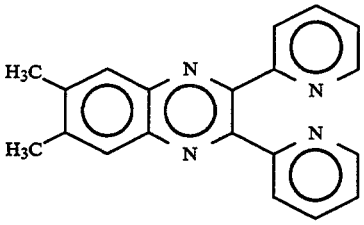

10.
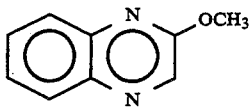

11.
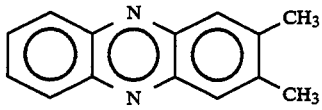

12.
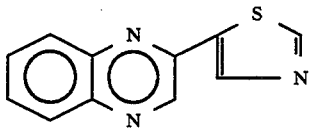

In these exemplified compounds, the exemplified compounds No. 2 and No. 7 are preferably employed.

The amount to be added of the compound of the formula (1) in the present invention is preferably in the range of from 0.2 to 30%, more preferably from 0.4 to 15% by weight, based on the weight of the layer to which the compound is added. With the amount of addition of less than 0.2% by weight, the prevention of the deterioration may be insufficient, while with the amount of the addition of more than 30% by weight, the sensitivity or the residual potential is liable to be adversely affected.

The compound of the formula (1) may be used individually or in combination of two or more thereof, and further may be used in combination with an additive such as an antioxidant, a UV absorber, and a plasticizer.

The photosensitive layer employed in the electrophotographic photosensitive member of the present invention may be of a monolayer type which contains a charge-generating substance and a charge-transporting substance one and the same layer, or may be of a lamination type which comprises a charge-generating layer containing a charge-generating substance and a charge-transporting layer containing a charge-transporting substance.

The charge-generating substance may be any substance which has charge-generating ability, including the substances below:

(1) Azo type pigments including monoazo, bisazo, and trisazo type pigments,
(2) Phthalocyanine pigments including metal phthalocyanine and non-metal phthalocyanine,
(3) Indigo type pigments including indigo and thioindigo,
(4) Perylene type pigments including perylenic anhydride and perylenimide,
(5) Polycyclic quinones type pigments including anthraquinone and pyrene quinone,
(6) Squarilium dyes,
(7) Pyrylium salts and thiopyrylium salts,
(8) Triphenylmethane dyes,
(9) Inorganic substances such as selenium and amorphous silicon.

These charge-generating substances may be used individually or in combination of two or more thereof.

The charge-transporting substance is selected from hydrazone type compounds, stilbene type compounds, carbazole type compounds, pyrazoline type compounds, oxazole type compounds, thiazole type compounds, triarylmethane type compounds, polyarylalkanes, and the like. These may be used individually or in combination of two or more thereof. The higher the oxidation potential of the charge-transporting substance, the higher is the durability thereof. The improvement of the durability is more remarkable with the substances having the oxidation potential of 0.6 V or higher, particularly 0.7 V or higher.

In a lamination type of photosensitive layer, the charge-generating layer may be formed by dispersing the aforementioned charge-generating substance together with a suitable solvent in a binder resin and applying the dispersion on an electroconductive support and drying, or otherwise may be formed by depositing the substance in a thin film on an electroconductive support according to a dry process such as sputtering, and CVD.

The aforementioned binder resins include polycarbonates, polyesters, polyarylates, butyral resins, polystyrenes, polyvinylacetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloridevinyl acetate copolymers, but is not limited thereto. These resins may be used individually or in combination of two or more thereof. The resin contained in the charge-generating layer is in an amount of not more than 80% by weight, more preferably not more than 40% by weight based on the total weight of the charge-generating layer.

The charge-generating layer has a film thickness preferably not more than 5 μm, more preferably in the range of from 0.01 to 2 μm.

The charge-generating layer may further contain a sensitizer.

The charge-transporting layer may be formed by dissolving the aforementioned charge-transporting substance in a suitable binder resin with the aid of a suitable solvent, and applying to a charge-generating layer and drying the resulting solution.

The binder resin includes the resins mentioned above for the charge-generating resin and additionally includes photoelectric polymers such as polyvinylcarbazole and polyvinylanthracene. The blending ratio of the charge-transporting substance to the binder resin is preferably in the range of from 10 to 500 parts by weight of the charge-transporting substance to 100 parts by weight of the binder resin.

The charge-transporting layer has a thickness preferably in the range of from 5 to 40 μm, more preferably from 10 to 30 μm.

In the present invention, a compound represented by the formula (1) may be contained in any layers of a charge-generating layer, a charge-transporting layer, and a protecting layer as mentioned below as well as a single type of a photosensitive layer. When the photosensitive layer on which the charge-transporting layer is laminated, the compound represented by the formula (1) may be contained preferably in at least one of the charge-transporting layer or the protecting layer, more preferably in the charge-transporting layer.

The charge-transporting layer may be laminated on the charge-generating layer, or conversely the charge-generating layer may be laminated on the charge-transporting layer, in the present invention.

In the case where the photosensitive layer is of a monolayer type, it may be formed by dispersing and dissolving the charge-generating substance and the charge-transporting substance in the aforementioned binder resin and applying and drying the resulting liquid. The film thickness is preferably in the range of from 5 to 40 μm, more preferably from 10 to 30 μm.

The present invention is particularly suitably employed in the cases where the durability of the photosensitive member is improved by use of a charge-transporting substance having a relatively high oxidation potential (e.g., 0.6 V or higher), or where the durability is improved by applying a lubricant, or additionally a dispersing agent for dispersing the lubricant uniformly on the surface layer to reduce the abrasion of the photosensitive member.

The lubricant suitably used in the present invention includes powdery fluoro-resins, powdery polyolefin resins, powdery silicone resins, powdery fluorinated carbon, and the like. Powdery fluoro-resins are preferred in view of lubricity and releasability. The powdery fluoro-resins include tetrafluoroethylene resins, chlorotrifluoroethylene resins, tetrafluoroethylene-hexafluoropropylene resins, vinyl fluoride resins, vinylidene fluoride resins, difluorochloroethylene resins and copolymers comprising polymer components of these resins. The powdery polyolefins includes polyethylenes, polypropylenes, and copolymers comprising components of these polymers. The amount of addition of such a lubricant is preferably in the range of from 1 to 100%, more preferably from 1.5 to 30% by weight based on the binder resin in the layer to which the lubricant is added.

A subbing layer, which has a barrier function and an adhesion function, may be provided between the electroconductive support and the photosensitive layer in the present invention. The material for the subbing layer includes polyvinyl alcohol, polyethylene oxide, ethylcellulose, methylcellulose, casein, polyamides, glue and gelatin. The material is dissolved in a suitable solvent and applied on the electroconductive support. The thickness of the resulting layer is preferably not more than 5 μm, more preferably in the range of from 0.2 to 3.0 μm.

Further, a protecting layer, which is made of a simple resin layer or a resin layer containing an electroconductive substance dispersed therein, may be provided on the photosensitive layer in the present invention for the purpose of protecting the photosensitive layer from various external mechanical and electrical forces. The protecting layer is included in the photosensitive layer in the present invention.

The above-described layers are formed on the electroconductive support by use of a suitable organic solvent according to a coating method such as immersion coating, spray coating, spinner coating, roller coating, Meyer bar coating, and blade coating.

The electroconductive support in the present invention may be in such a structure as shown below:

(1) A metal such as aluminum, aluminum alloys, stainless steel, and copper, (2) A non-electroconductive support such as glass, a resin, or paper, or an electroconductive support mentioned in the above item (1) on which a film of a metal such as aluminum, palladium, rhodium, gold, and platinum is formed by dispersion, vapor-deposition, or lamination, and (3) A non-electroconductive support such as glass, a resin, or paper, or an electroconductive support mentioned in the above item (1) on which a layer of an electroconductive polymer, a layer of electroconductive compound such as tin oxide, and indium oxide, or a layer of a resin containing such electroconductive compound dispersed therein is formed by vapor-deposition, or coating.

The electroconductive support may be in a shape of a drum, a sheet, or a belt, but is not limited thereto.

The electrophotographic photosensitive member of the present invention is not only applicable to electrophotographic copying machines but also applicable widely in electrophotographic fields including laser printers, CRT printers, facsimile machines, electrophotographic engraving systems, and the like.

FIG. 1 illustrates roughly an example of the constitution of an electrophotographic apparatus employing the photosensitive member of the present invention.

In FIG. 1, a drum type photosensitive member 1 serves as an image carrier, being driven to rotate around the axis 1*a* in the arrow direction at a predetermined peripheral speed. The photosensitive member 1 is charged positively or negatively at the peripheral face uniformly during the rotation by an electrostatic charging means 2, and then exposed to image-exposure light L (e.g. slit exposure, laser beam-scanning exposure, etc.) at the exposure portion 3 with an image-exposure means (not shown in the drawing), whereby electrostatic latent images are sequentially formed on the peripheral surface of the photosensitive member in accordance with the exposed image.

Thus formed electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixiation of the image and sent out of the copying machine as a duplicate copy.

The surface of the photosensitive member 1, after the image transfer, is cleaned with a cleaning means 6 to remove any remaining un-transferred toner, and is treated for charge elimination with a pre-exposure means 7 for repeated use for image formation.

The generally employed charging means 2 for uniformly charging the photosensitive member 1 is a corona charging apparatus. The generally employed transfer means 5 is also a corona charging means. In the electrophotographic apparatus, two or more of the constitutional elements of the above described photosensitive member, the developing means, the cleaning means, etc. may be integrated into one device unit, which may be made demountable from the main body of the apparatus. For example, at least one of the charging means, the developing means, and the cleaning means is combined with the photosensitive member 1 into one device unit which is demountable from the main body of the apparatus by aid of a guiding means such as a rail in the main body of the apparatus. An electrostatic charging means and/or a developing means may be combined with the aforementioned device unit.

When the electrophotographic apparatus is used as a copying machine or a printer, the light L for optical image exposure may be projected onto the photosensitive member as reflected light or transmitted light from an original copy, or otherwise the information read out by a sensor from an original is signalized, and according to the signalized information light is projected onto a photosensitive member, by scanning with a laser beam, driving an LED array, or driving a liquid crystal shutter array.

Figure 2:
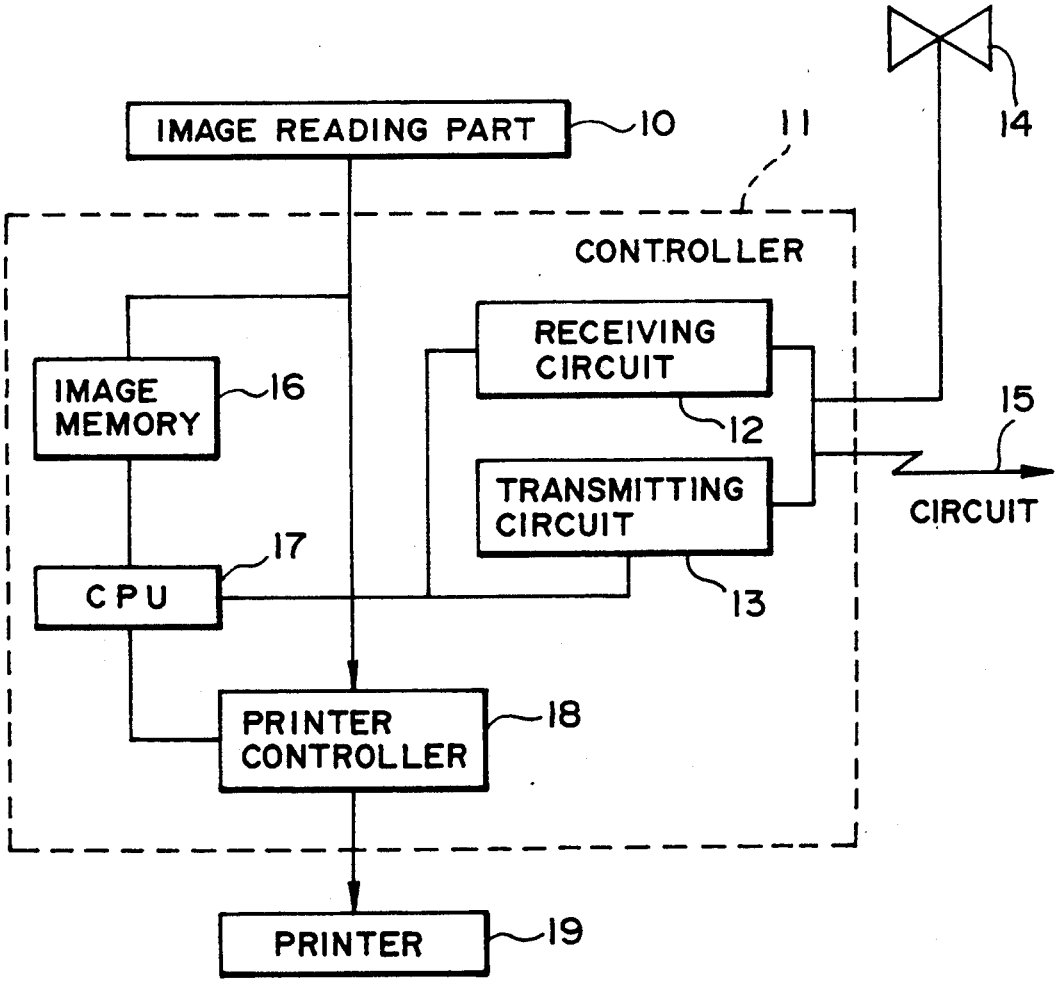
FIG. 2 illustrates an example of a block diagram of a facsimile system employing the photosensitive member of the present invention.

When the electrophotographic apparatus is used as a printer of a facsimile machine, the optical image exposure light L is for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in image memory 16. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of image information has been stored in the image memory 16, the images are recorded in such a manner that the CPU 17 reads out the one page of image information, and sends out the decoded one page of information to the printer controller 18, which controls the printer 19 on receiving the one page of information from CPU 17 to record the image information.

During recording by the printer 19, the CPU 17 receives the subsequent page of information.

Images are received and recorded in the manner as described above.

The present invention is described in more detail by reference to Examples.

In Examples, the oxidation potential was shown by the peak position of the current-potential curve which was obtained by sweeping the potential of the working electrode by means of a potential sweeper by use of a saturated calomel electrode as the reference electrode, and 0.1N $(n-Bu)_4N^+ClO_4$ in acetonitrile as the electrolyte solution. More specifically, the sample was dissolved in the 0.1N $(n\text{-}Bu)_4N^+ClO_4$ in acetonitrile as the electrolyte at a concentration of form 5 to 10 mmol %. Then a potential was applied to this sample solution and the potential was raised linearly from a low potential. The change of the current was measured to obtain a current-potential curve. The potential value at the first inflection point in the current-potential curve was taken as the oxidation potential of the present invention.

The unit "part" is based on weight hereinafter.

EXAMPLE 1

An aluminum cylinder of 80 mm diameter and 360 mm long was employed as the electroconductive support. Onto this support, 5% solution of a polyamide resin (Amylan CM-8000, made by Toray Industries, Inc.) in methanol was applied by immersion coating to form a subbing layer of 0.5 μm thick.

Subsequently, 10 parts of the trisazo pigment represented by the formula below:

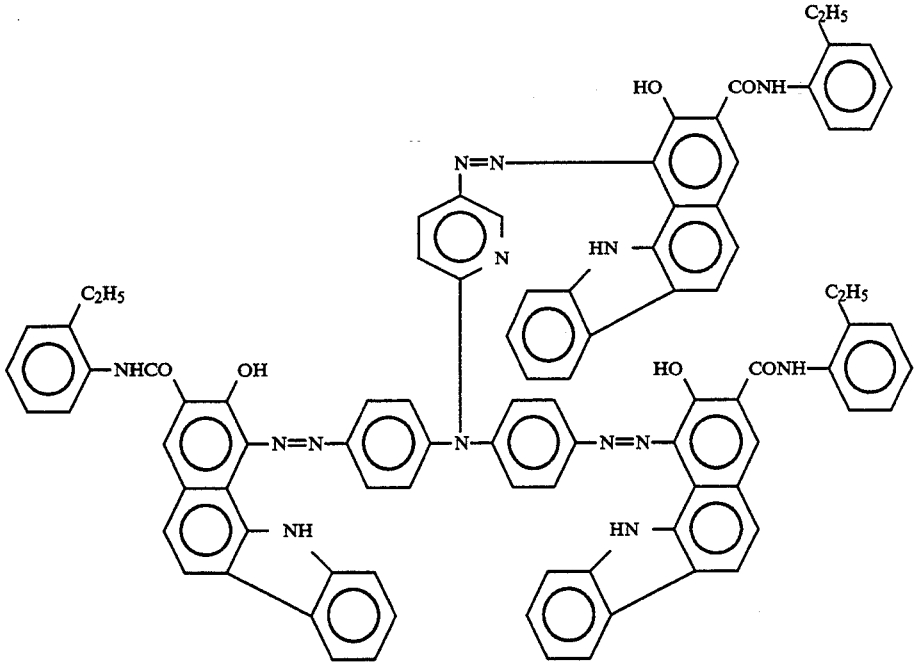

6 parts of a polyvinylbutyral resin (Eslec BL-S, made by Sekisui Chemical Co., Ltd.), and 50 parts of cyclohexanone were dispersed by means of a sand mill employing glass beads. This liquid dispersion was diluted with 100 parts of methyl ethyl ketone, and the resulting liquid was applied on the above subbing layer by immersion coating to form a charge-generating layer of 0.2 μm thick.

Then, 10 parts of the stilbene compound (oxidation potential: 0.81 V) represented by the formula below:

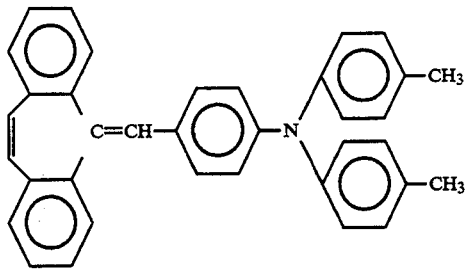

and 10 parts of a Polycarbonate resin (Panlite L-1250, made by Teijin Kasei K.K.) were dissolved in a mixture of 50 parts of dichloromethane and 10 parts of monochlorobenzene. To this solution, the liquid dispersion was added which had been separately prepared by dispersing 1 part of a tetrafluoroethylene resin (Lubron L-2, made by Daikin Industries, Ltd.) and 0.1 part of a dispersing agent (Arron GF-300, made by Toagosei Chemical Industry Co., Ltd.) in 10 parts of monochlorobenzene. Further thereto, 0.1 part of quinoxaline (Exemplified Compound No. 1) was added. This solution was applied onto the above charge-generating layer by immersion coating to form a charge-transporting layer of 19 μm thick.

The resulting electrophotographic photosensitive member was set in an electrophotographic copying machine (NP-3825, made by Canon K.K.), and the properties of the electrophotographic photosensitive member were measured as below.

Firstly, the conditions for latent image formation were determined to achieve the dark area potential ($V_D$) of −650 V and the light area potential ($V_L$) of −150 V. The quantity of image exposure therefor was defined as the initial sensitivity. After 5000 sheets of copying was practiced continuously, the values of $V_D$ and $V_L$ were measured, and the fall of $V_D$ and the rise of $V_L$ were determined. Thereafter, the photosensitive member was left standing in the copying machine. The portion of the photosensitive member left standing directly below the corona charger is marked. After standing for 10 hours, the photosensitive member was subjected to measurement of the surface potentials at the portion of the member which had been left directly below the corona charger and at the portion which was not directly below the corona charger, and the difference of the two potentials ($\Delta V_D$) was derived. The quality of the image after 5000 sheets of copying was evaluated visually.

The results are shown in Table 1.

EXAMPLE 2

A photosensitive member was prepared and evaluated in the same manner as in Example 1 except that the amount of the quinoxaline was changed to 0.5 part.

The results are shown in Table 1.

Comparative Example 1

A photosensitive member was prepared and evaluated in the same manner as in Example 1 except that the quinoxaline was not used.

The results are shown in Table 1.

Comparative Example 2

A photosensitive member was prepared and evaluated in the same manner as in Example 1 except that 2,6-di-p-tolylpyridine was used instead of the quinoxaline.

The results are shown in Table 1.

EXAMPLE 3

A subbing layer was provided on an electroconductive support in the same manner as in Example 1.

10 Parts of a disazo pigment represented by the formula below as the charge-generating substance:

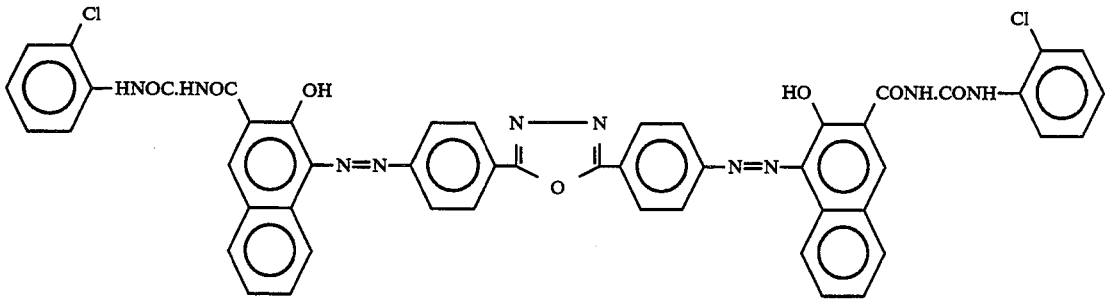

6 parts of a polyvinylbutyral resin (Eslec BX-1, made by Sekisui. Chemical Co., Ltd.), and 50 parts of cyclohexanone were dispersed by means of a sand mill employing glass beads. This dispersion was diluted with 100 parts of tetrahydrofuran. The diluted dispersion was applied on the above subbing layer to form a charge-generating layer of 0.2 μm thick.

Separately, a solution for the charge-transporting layer was prepared in the same manner as in Example 1 except that 2,3-dimethylquinoxaline (Exemplified Compound No. 2) was used instead of the quinoxaline. This solution was applied on the above charge-generating layer by immersion coating to form a charge-transporting layer of 19 μm thick.

The resulting photosensitive member was evaluated in the same manner as in Example 1.

The results are shown in Table 2.

EXAMPLE 4

A photosensitive member was prepared in the same manner as in Example 3 except that the amount of the 2,3-dimethylquinoxaline was changed to 0.5 part.

The results are shown in Table 2.

Comparative Example 3

A photosensitive member was prepared and evaluated in the same manner as in Example 3 except that the 2,3-dimethylquinoxaline was not used.

The results are shown in Table 2.

Comparative Example 4

A photosensitive member was prepared and evaluated in the same manner as in Example 4 except that 4,4'-dipyridyl was used instead of the 2,3-dimethylquinoxaline.

The results are shown in Table 2.

EXAMPLE 5

A subbing layer was provided on an electroconductive support in the same manner as in Example 1.

10 Parts of a disazo pigment represented by the formula below as the charge-generating substance:

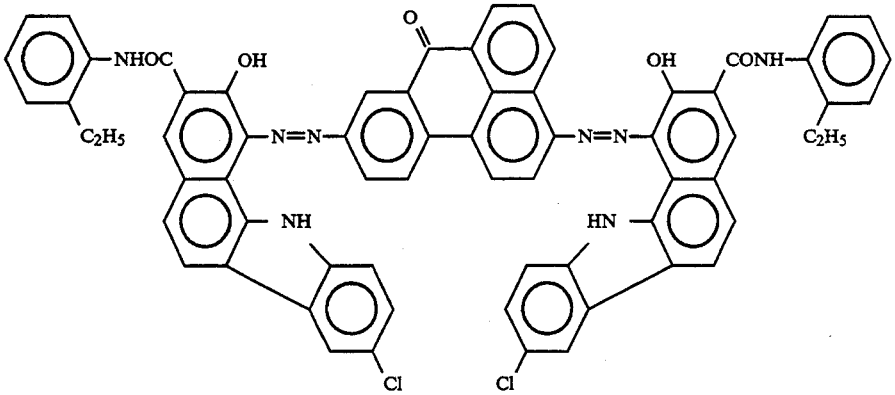

6 parts of a polyvinylbutyral resin (Eslec BX-1, made by Sekisui Chemical Co., Ltd.), and 50 parts of cyclohexanone were dispersed by means of a sand mill employing glass beads. This liquid dispersion was diluted by 100 parts of tetrahydrofuran. The diluted dispersion was applied on the above subbing layer to form a charge-generating layer of 0.2 μm thick.

Separately, 8 parts of a benzocarbazole compound (oxidation potential: 0.83 V) represented by the formula below:

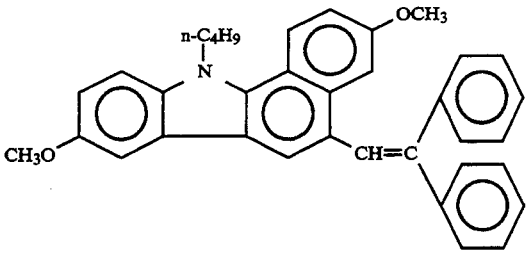

and 10 parts of a styrene-acryl copolymer resin (Estyrene MS-200, made by Nippon Steel Chemical Co., Ltd.) were dissolved in a mixture of 15 parts of dichloromethane and 45 parts of monochlorobenzene. One part of a tetrafluoroethylene resin (Lubron L-2, made by Daikin Industries, Ltd.) which had been dispersed, and 0.1 part of a dispersing agent (Modiper F-110, made by Nippon Oil and Fats Co., Ltd.) were added to the above solution. Further thereto, 0.1 part of 3-methyl-2-quinoxalinol (Exemplified Compound No. 3) was added. The resulting liquid mixture was applied onto the above charge-generating layer by immersion coating to form a charge-transporting layer of 19 μm thick.

The resulting photosensitive member was evaluated in the same manner as in Example 1.

The results are shown in Table 3.

EXAMPLE 6

A photosensitive member was prepared and evaluated in the same manner as in Example 5 except that the amount of the 3-methyl-2-quinoxalinol was changed to 0.5 parts.

The results are shown in Table 3. Comparative Example 5

A photosensitive member was prepared and evaluated in the same manner as in Example 5 except that the 3-methyl-2-quinoxalinol was not used.

The results are shown in Table 3.

Comparative Example 6

A photosensitive member was prepared and evaluated in the same manner as in Example 5 except that phenanthroline was used instead of the 3-methyl-2-quinoxalinol.

The results are shown in Table 3.

EXAMPLE 7

A subbing layer was provided on an electroconductive support in the same manner as in Example 1.

10 Parts of a disazo pigment represented by the formula below as the charge-generating substance:

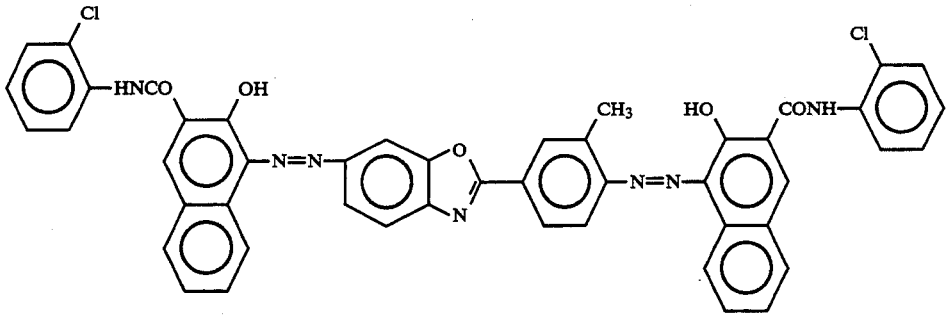

6 parts of a polyvinylbutyral resin (Eslec BX-1, made by Sekisui Chemical Co., Ltd.), and 50 parts of cyclohexanone were dispersed by means of a sand mill employing glass beads. This dispersion was diluted by 100 parts of tetrahydrofuran. The diluted dispersion was applied on the above subbing layer to form a charge-generating layer of 0.2 μm thick.

Separately, 8 parts of a compound (oxidation potential: 0.62 V) represented by the formula below as the charge-transporting substance:

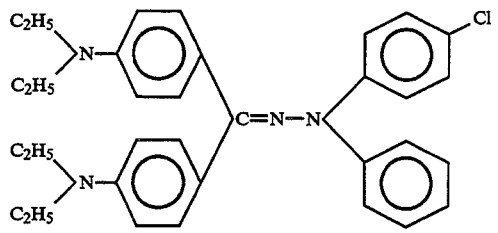

and 10 parts of a styrene-acryl copolymer resin (Estyrene MS-200, made by Nippon Steel Chemical Co., Ltd.) were dissolved in a mixture of 15 parts of dichloromethane and 45 parts of monochlorobenzene. One part of a tetrafluoroethylene resin (Lubron L-2, made by Daikin Industries, Ltd.) which had been dispersed and 0.1 part of a dispersing agent (Modiper F-110, made by Nippon Oil and Fats Co., Ltd.) were added to the above solution. Further thereto 0.1 part of 2-quinoxalinecarbonyl chloride (Exemplified Compound No. 6) was added. The resulting liquid mixture was applied onto the above charge-generating layer by immersion coating to form a charge-transporting layer of 19 μm thick.

The resulting photosensitive member was evaluated in the same manner as in Example 1.

The results are shown in Table 4.

EXAMPLE 8

A photosensitive member was prepared and evaluated in the same manner as in Example 7 except that the amount of the 2-quinoxalinecarbonyl chloride was changed to 0.5 parts.

The results are shown in Table 4.

Comparative Example 7

A photosensitive member was prepared and evaluated in the same manner as in Example 7 except that the 2-quinoxalinecarbonyl chloride was not used.

The results are shown in Table 4.

Comparative Example 8

A photosensitive member was prepared and evaluated in the same manner as in Example 7 except that dithio-bis-nitropyridine was used instead of 2-quinoxalinecarbonyl chloride.

The results are shown in Table 4.

EXAMPLE 9

A photosensitive member was prepared in the same manner as in Example 7 except that the compound (oxidation potential: 0.54 V) represented by the formula below was used as the charge-transporting substance:

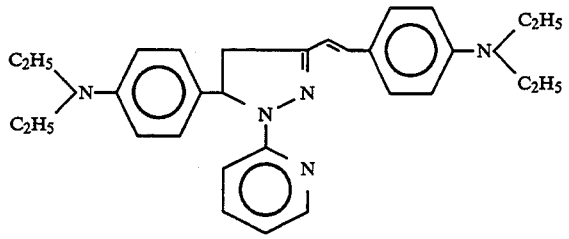

The results are shown in Table 5.

Comparative Example 9

A photosensitive member was prepared and evaluated in the same manner as in Example 9 except that 2-quinoxalinecarbonyl chloride was not used.

The results are shown in Table 5.

Comparative Example 10

A photosensitive member was prepared and evaluated in the same manner as in Example 9 except that diphenylpyridine was used instead of 2-quinoxalinecarbonyl chloride.

The results are shown in Table 5.

EXAMPLE 10

A subbing layer was provided on an electroconductive support in the same manner as in Example 1.

Then, 15 parts of the stilbene compound (oxidation potential: 0.81 V) represented by the formula below:

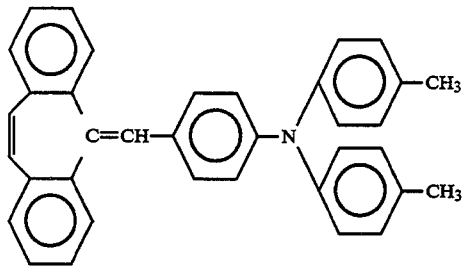

and 10 parts of a polycarbonate resin (trade name: Panlite L-1250, made by Teijin Kasei K.K.) were dissolved in a mixture of 50 parts of dichloromethane and 10 parts of monochlorobenzene. This solution was applied on the above subbing layer to form a charge-transporting layer of 15 μm thick.

4 Parts of the disazo pigment represented by the formula below:

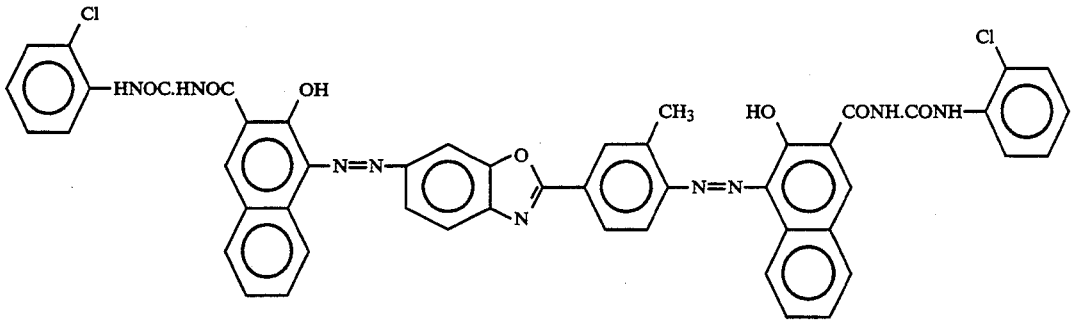

10 parts of a polyvinylbutyral resin (Eslec BL-S, made by Sekisui Chemical Co., Ltd.), and 0.63 part of phenazine (Exemplified compound No. 8) were dispersed and dissolved in a mixture of 150 parts of cyclohexane and 50 parts of tetrahydrofuran. The resulting coating liquid was applied on the above charge-transporting layer by spray coating to form a charge-generating layer of 5 μm thick.

Further, 1 part of a lubricant (Lubron L-2, made by Daikin Industries, Ltd.), 9 parts of the aforementioned polycarbonate, and 0.1 part of a dispersing agent (Modiper F-210, made by Nippon Oil and Fats Co., Ltd.) were dispersed and dissolved in 90 parts of monochlorobenzene. The solution was applied on the above charge-generating layer by spray coating to form a protecting layer of 3 μm thick.

The resulting photosensitive member was evaluated in the same manner as in Example 1 except that the charging polarity was positive, and $V_D$ was 650 V and $V_L$ was 150 V.

The results are shown in Table 6.

Comparative Example 11

A photosensitive member was prepared and evaluated in the same manner as in Example 10 except that phenazine was not used.

The results are shown in Table 6.

Comparative Example 12

A photosensitive member was prepared and evaluated in the same manner as in Example 10 except that 2,2'-dipyridyl was used instead of the phenazine.

The results are shown in Table 6.

EXAMPLE 11

A subbing layer was provided on an electroconductive support in the same manner as in Example 1.

5 Parts of the disazo pigment represented by the formula below:

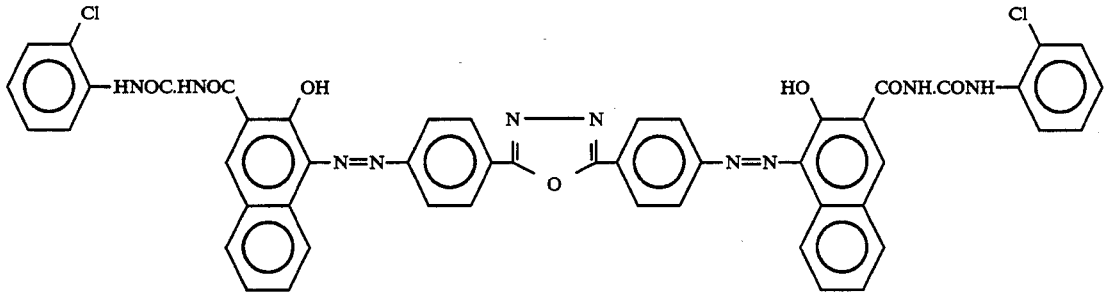

10 parts of the stilbene compound (oxidation potential: 0.81 V) represented by the formula below:

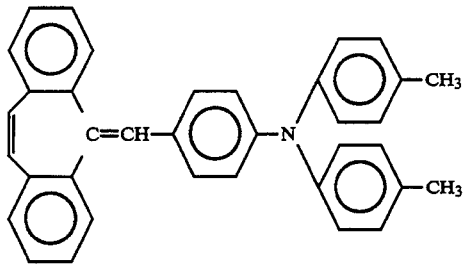

and 15 parts of a polycarbonate resin (Z-200, made by Mitsubishi Gas Chemical Co., Inc.) were dispersed and dissolve in 170 parts of monochlorobenzene by means of a sand mill. Further thereto, 1 part of 6,7-dimethyl-2,3-dipyridylquinoxaline (Exemplified compound No. 9) was added. This solution was applied on the above subbing layer by immersion coating to form a photosensitive layer of 20 μm thick.

The resulting photosensitive member was evaluated in the same manner as in Example 1.

The results are shown in Table 7.

Comparative Example 13

A photosensitive member was prepared and evaluated in the same manner as in Example 11 except that 6,7-dimethyl-2,3-dipyridylquinoxaline was not used.

The results are shown in Table 7.

As described above, the present invention provides an electrophotographic photosensitive member which gives images of high quality stably even after repeated use without blurring or blanking of the images.

TABLE 1

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 1 | No. 1 | 0.1 | 2.5 | 20 | 15 | 25 | Good |
| Example 2 | No. 1 | 0.5 | 2.6 | 10 | 20 | 10 | Good |
| Comparative Example 1 | — | — | 2.5 | 60 | 10 | 90 | White blank |
| Comparative Example 2 | 2,6-di-p-tolylpyridine | 0.1 | 2.5 | 55 | 20 | 90 | White blank |

TABLE 2

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 3 | No. 2 | 0.1 | 2.1 | 15 | 15 | 20 | Good |
| Example 4 | No. 2 | 0.5 | 2.1 | 10 | 15 | 20 | Good |
| Comparative Example 3 | — | — | 2.1 | 70 | 10 | 80 | White blank |
| Comparative Example 4 | 4,4'-dipyridyl | 0.5 | 2.3 | 20 | 55 | 20 | Fogging |

TABLE 3

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 5 | No. 3 | 0.1 | 2.5 | 25 | 15 | 20 | Good |
| Example 6 | No. 3 | 0.5 | 2.6 | 15 | 15 | 10 | Good |
| Comparative Example 5 | — | — | 2.5 | 70 | 15 | 85 | White blank |
| Comparative Example 6 | Phenanthroline | 0.1 | 3.8 | 45 | 25 | 40 | Fogging |

TABLE 4

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 7 | No. 6 | 0.1 | 3.0 | 25 | 15 | 20 | Good |
| Example 8 | No. 6 | 0.5 | 3.1 | 15 | 15 | 15 | Good |
| Comparative Example 7 | — | — | 3.0 | 75 | 20 | 70 | White blank |
| Comparative Example 8 | Dithio-bis-nitropyridine | 0.1 | 3.0 | 65 | 25 | 60 | White blank |

TABLE 5

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 9 | No. 6 | 0.1 | 2.8 | 15 | 15 | 25 | Good |
| Comparative Example 9 | — | — | 2.8 | 35 | 15 | 50 | Blurring |
| Comparative Example 10 | Diphenylpyridine | 0.1 | 3.0 | 30 | 25 | 45 | Blurring |

TABLE 6

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 10 | No. 8 | 0.63 | 4.2 | 20 | 15 | 20 | Good |
| Comparative Example 11 | — | — | 4.0 | 100 | 15 | 100 | White blank |
| Comparative Example 12 | 2,2'-dipyridyl | 0.63 | 4.2 | 30 | 60 | 25 | Blurring |

TABLE 7

| | Additive | Amount of additive (parts) | Initial sensitivity (lux.sec) | Fall of $V_D$ (V) | Rise of $V_L$ (V) | $\Delta V_D$ (V) | Image quality |
|---|---|---|---|---|---|---|---|
| Example 11 | No. 9 | 1 | 4.1 | 30 | 30 | 25 | Good |
| Comparative Example 13 | — | — | 4.0 | 100 | 50 | 70 | White blank |

What is claimed is:

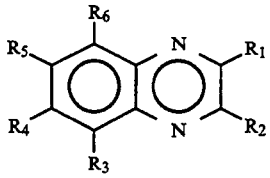

(1)

represented by the formulas (2) and (3) as follows:

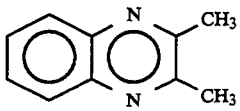

(2)

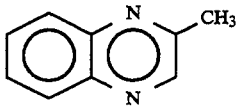

(3)

2. An electrophotographic photosensitive member according to claim 1, further comprising a subbing layer.

3. An electrophotographic photosensitive member according to claim 1, wherein said compound is a compound represented by the formula (2) below:

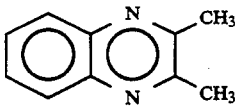

(2)

4. An electrophotographic photosensitive member according to claim 1, wherein said compound is a compound represented by the formula (3):

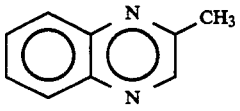

(3)

5. An electrophotographic photosensitive member according to claim 1, wherein the amount of said compound is 0 2 to 30% by weight based on the total weight of the layer to which said compound is added.

6. An electrophotographic photosensitive member according to claim 5, wherein the amount of said compound is 0.4 to 15% by weight based on the total weight of the layer to which said compound is added.

7. An electrophotographic photosensitive member according to claim 1, wherein said photosensitive layer comprises a charge-generating layer and a charge-transporting layer.

8. An electrophotographic photosensitive member according to claim 7, comprising an electroconductive support, a charge-generating layer and a charge-transporting layer in the order named.

9. An electrophotographic photosensitive member according to claim 7, comprising an electroconductive support, a charge-transporting layer and a charge-generating layer in the order named.

10. An electrophotographic photosensitive member according to claim 1, wherein said photosensitive layer is a single layer.

11. An electrophotographic photosensitive member according to claim 1, wherein said photosensitive layer has a protecting layer.

12. An electrophotographic photosensitive member according to claim 7, wherein said charge-transporting layer contains a compound selected from compounds represented by the formulas (2) and (3).

13. An electrophotographic photosensitive member according to claim 7, wherein said charge-generating layer contains a compound selected from compounds represented by the formulas (2) and (3).

14. An electrophotographic photosensitive member according to claim 8, wherein said charge-transporting layer contains a compound selected from compounds represented by the formulas (2) and (3).

15. An electrophotographic photosensitive member according to claim 11, wherein said protecting layer contains a compound selected from compounds represented by the formulas (2) and (3).

16. An electrophotographic photosensitive member according to claim 1, wherein said photosensitive layer comprises a charge-transporting substance having the oxidation potential of not less than 0.6 V.

17. An electrophotographic photosensitive member according to claim 1, wherein a surface layer of the photosensitive layer contains a lubricant.

18. An electrophotographic photosensitive member according to claim 17, wherein said lubricant is selected from the group consisting of powdery fluoro-resins, powdery polyolefin resins, powdery silicone resins and powdery fluorinated carbon.

19. An electrophotographic photosensitive member according to claim 18, wherein said lubricant is powdery fluoro-resins.

20. An electrophotographic apparatus comprising an electrophotographic photosensitive member, an image forming means for forming a latent image, a developing means for developing the formed latent image, and a transferring means for transferring a developed image to a transfer-receiving material, said electrophotographic photosensitive member comprising an electroconductive support and a photosensitive layer formed thereon, the photosensitive layer contains a compound

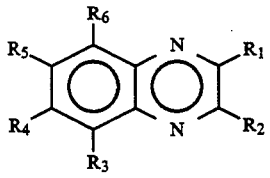

(1)

represented by the formulas (2) and (3) as follows:

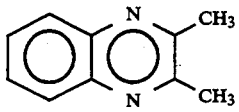

(2)

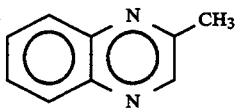

(3)

21. A device unit comprising an electrophotographic photosensitive member and at least one selected from the group consisting of a charging means, a developing means and a cleaning means, said electrophotographic photosensitive member comprising an electroconductive support and a photosensitive layer formed thereon, the photosensitive layer contains a compound

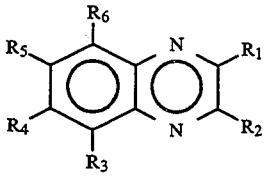

(1)

represented by the formulas (2) and (3) as follows:

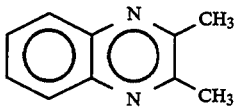

(2)

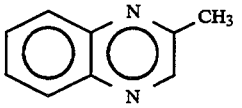

(3)

said unit holding integrally the electrophotographic photosensitive member and the at least one selected from the group consisting of the charging means, the developing means and the cleaning means and being removable from the main body of an electrophotographic apparatus.

22. A fascimile machine comprising an electrophotographic apparatus and a means for receiving image information from a remote terminal, said electrophotographic apparatus comprising an electrophotographic photosensitive member, said electrophotographic photosensitive member comprising an electroconductive support and a photosensitive layer formed thereon, said photosensitive layer containing a compound

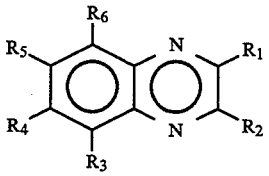

(1)

represented by the formulas (2) and (3) as follows:

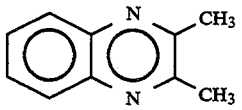

(2)

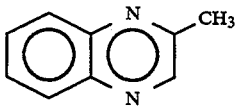

(3)

* * * * *

UNITED STATES PATENT AND TRADEMARK OFFICE

CERTIFICATE OF CORRECTION

PATENT NO. : 5,389,478

DATED : February 14, 1995

INVENTOR(S) : AKIRA YOSHIDA, ET AL.

It is certified that error appears in the above-identified patent and that said Letters Patent is hereby corrected as shown below:

COLUMN 2

Line 52, "nor" should read --or--.

COLUMN 5

Line 21, "one" should read --in one--.

COLUMN 6

Line 5, "chloridevinyl" should read --chloride-vinyl--.

COLUMN 7

Line 5, "includes" should read --include--.

COLUMN 8

Line 22, "fixiation" should read --fixation--;
Line 26, "un-transferred" should read --untransferred--;
Line 34, "above described" should read --above-described--; and
Line 62, "entire" should read --entirety--.

COLUMN 9

Line 56, "form" should read --from--.

COLUMN 10

Line 57, "Polycarbonate" should read --polycarbonate--.

UNITED STATES PATENT AND TRADEMARK OFFICE

CERTIFICATE OF CORRECTION

PATENT NO. : 5,389,478

DATED : February 14, 1995

INVENTOR(S) : AKIRA YOSHIDA, ET AL.

It is certified that error appears in the above-identified patent and that said Letters Patent is hereby corrected as shown below:

COLUMN 12

Line 5, "10 Parts" should read --10 parts--; and
Line 67, "10 Parts" should read --10 parts--.

COLUMN 14

Line 28, "Comparative" should read --¶ Comparative--; and
Line 45, "10 Parts" should read --10 parts--.

COLUMN 16

Line 66, "4 Parts" should read --4 parts--.

COLUMN 18

Line 15, "5 Parts" should read --5 parts--.

COLUMN 19

Table 1, "$\Delta V_D$ (V) 25" should read --$\Delta V_D$ (V) 15--.

COLUMN 21

Line 2, " 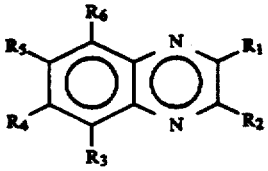 " should read

--1. An electrophotographic photosensitive member comprising an electroconductive support, and a photosensitive layer formed thereon, the photosensitive layer containing a compound--.

UNITED STATES PATENT AND TRADEMARK OFFICE

CERTIFICATE OF CORRECTION

PATENT NO. : 5,389,478

DATED : February 14, 1995

INVENTOR(S) : AKIRA YOSHIDA, ET AL.

It is certified that error appears in the above-identified patent and that said Letters Patent is hereby corrected as shown below:

COLUMN 22

Line 46, " 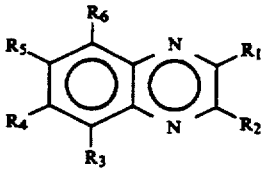 " should be deleted.

Signed and Sealed this

Twenty-third Day of May, 1995

Attest:

Attesting Officer

BRUCE LEHMAN

Commissioner of Patents and Trademarks